US009658580B2

(12) United States Patent
Saito et al.

(10) Patent No.: US 9,658,580 B2
(45) Date of Patent: May 23, 2017

(54) IMAGE FORMING APPARATUS

(71) Applicant: CANON KABUSHIKI KAISHA, Tokyo (JP)

(72) Inventors: Shuji Saito, Suntou-gun (JP); Naoto Tsuchihashi, Yokohama (JP); Yoshisuke Kasuya, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/528,073

(22) Filed: Oct. 30, 2014

(65) Prior Publication Data

US 2015/0132020 A1 May 14, 2015

(30) Foreign Application Priority Data

Nov. 8, 2013 (JP) ..... 2013-232107

(51) Int. Cl.
*G03G 15/20* (2006.01)
*G03G 21/20* (2006.01)

(52) U.S. Cl.
CPC ..... *G03G 15/2017* (2013.01); *G03G 21/206* (2013.01)

(58) Field of Classification Search
USPC ..... 399/92
See application file for complete search history.

(56) References Cited

U.S. PATENT DOCUMENTS 7,720,430 B2 * 5/2010 Hasegawa et al. ..... 399/397
8,346,116 B2 * 1/2013 Tsuda et al. ..... 399/92
8,779,335 B2 7/2014 Saito
2002/0085855 A1 * 7/2002 Baughman ..... G03G 21/206 399/92
2004/0234301 A1 * 11/2004 Sato ..... G03G 15/0194 399/299
2005/0271414 A1 * 12/2005 Katayama ..... G03G 21/206 399/93
2008/0170876 A1 * 7/2008 Sakai et al. ..... 399/93
2009/0010672 A1 * 1/2009 Watanabe ..... G03G 21/206 399/92
2011/0229166 A1 * 9/2011 Mori et al. ..... 399/43
(Continued)

FOREIGN PATENT DOCUMENTS

JP 2000-259064 A 9/2000
JP 2008-90198 A 4/2008
(Continued)

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

An image forming apparatus includes: a fixing portion for heat-fixing the image on a recording material; a duct including a suction port for sucking air from outside of the image forming apparatus and an exhaust port for delivering the air to the outside of the image forming apparatus; and a fan for forming a flow of the air from the suction port toward the exhaust port in the duct. The duct includes a merging portion, between the suction port and the exhaust port, for merging the air from the neighborhood of the fixing portion with the flow of the air by taking the air from the neighborhood of the fixing portion inside the duct. The recording material on which the image is fixed at the fixing portion is cooled by the air delivering through the exhaust port.

20 Claims, 6 Drawing Sheets

(A)

(B)

(56) References Cited

U.S. PATENT DOCUMENTS

| | | | | |
|---|---|---|---|---|
| 2012/0076510 | A1* | 3/2012 | Mizuno | G03G 15/20 399/12 |
| 2012/0087693 | A1* | 4/2012 | Yamaguchi et al. | 399/92 |
| 2012/0315061 | A1* | 12/2012 | Kondo | G03G 21/206 399/92 |
| 2013/0051835 | A1* | 2/2013 | Kubo | G03G 21/206 399/92 |
| 2013/0108306 | A1 | 5/2013 | Saito et al. | |
| 2013/0136485 | A1* | 5/2013 | Takahashi | G03G 21/206 399/92 |
| 2013/0177332 | A1 | 7/2013 | Saito | |
| 2013/0302060 | A1 | 11/2013 | Moriya et al. | |
| 2014/0153938 | A1 | 6/2014 | Saito | |
| 2014/0233995 | A1 | 8/2014 | Kasuya et al. | |
| 2015/0098723 | A1* | 4/2015 | Mitorida et al. | 399/92 |

FOREIGN PATENT DOCUMENTS

| | | | |
|---|---|---|---|
| JP | 2012-13882 | A | 1/2012 |
| JP | 2013-114134 | A | 6/2013 |
| JP | 2013-190762 | A | 9/2013 |

* cited by examiner (A)

(B)

(A)

(B)

IMAGE FORMING APPARATUS

FIELD OF THE INVENTION AND RELATED ART

The present invention relates to an image forming apparatus including a fixing portion.

In an electrophotographic copying machine or printer, a toner member formed by a developing process is heated after being transferred onto a recording material (sheet), so that the toner image is fixed on the sheet. Then, the sheet on which the toner image has already been fixed is generally discharged and stacked on a tray at a sheet discharging portion including a discharging roller (pair). As a problem when the sheet is stacked on the tray, there is a problem described below. There is a problem such that sheets to which electric charges are given repel each other on the tray in a process in which the toner image is transferred onto the sheets, and as a result, a phenomenon occurs in which the sheets are disorderly stacked on the tray, i.e., improper orientation occurs. This is phenomenon becomes more conspicuous during double-side printing in which the amount of the electric charges given to the sheet is large, and as a result the sheets are disorderly stacked, and there is a possibility that the disorderly stacked sheets lead to dropping of sheets from the tray.

Therefore, in order to suppress the above-described improper orientation, measures to remove the electric charges held by the sheet are taken. Japanese Laid-pen Patent Application (JP-A) 2012-13882 discloses a technique such that air containing water generated in a fixing device (apparatus) is sucked by a single fan and then a discharged sheet after the toner image is fixed on the sheet is charge-removed by the air, containing the water, delivered from the fan.

However, in the above constitution, in the case where the temperature of the air sucked by the fan increases, also the temperature of the air delivered by the fan increases, and therefore there is a problem that there is a possibility of lowering the discharged-sheet, sticking-preventing effect by lowering the cooling performance of the sheet based on the air delivered by the fan.

SUMMARY OF THE INVENTION

A principal object of the present invention is to provide an image forming apparatus capable of alleviating the lowering of discharged sheet cooling performance by enabling a lowering of the sucked air temperature of a fan.

According to an aspect of the present invention, there is provided an image forming apparatus for forming an image on a recording material, comprising: a fixing portion for heat-fixing the image, formed on the recording material, on the recording material; a duct including a suction port for sucking air from outside of the image forming apparatus and an exhaust port for delivering the air to the outside of the image forming apparatus; and a fan for forming a flow of the air from the suction port toward the exhaust port in the duct. The duct includes a merging portion, between the suction port and the exhaust port, for merging the air from the neighborhood of the fixing portion with the flow of the air by taking the air from the neighborhood of the fixing portion inside the duct. The recording material on which the image is fixed at the fixing portion is cooled by the air delivering through the exhaust port.

According to another aspect of the present invention, there is provided an image forming apparatus for forming an image on a recording material, comprising: a fixing portion for heat-fixing the image, formed on the recording material, on the recording material; a duct including a suction port for sucking air from outside of the image forming apparatus and an exhaust port for delivering the air to the outside of the image forming apparatus; and a fan for forming a flow of the air from the suction port toward the exhaust port in the duct. The fan is provided at a position closer to the exhaust port than to the merging portion of the duct. The duct includes a merging portion, between the suction port and the exhaust port, for merging the air from the neighborhood of the fixing portion with the flow of the air by taking the air from the neighborhood of the fixing portion inside the duct. The airflow rate of the air sucked at the suction port is larger than an airflow rate of the air merged from the neighborhood of the fixing portion at the merging portion.

According to a further aspect of the present invention, there is provided an image forming apparatus for forming an image on a recording material, comprising: a fixing portion for heat-fixing the image, formed on the recording material, on the recording material; a discharging portion for discharging the recording material, on which the recording material is fixed at the fixing portion, to outside of the image forming apparatus; a duct including a suction port for sucking air from the outside of the image forming apparatus and an exhaust port for delivering the air to the outside of the image forming apparatus; and a fan for forming a flow of the air from the suction port toward the exhaust port in the duct. The fan is provided at a position closer to the exhaust port than to the merging portion of the duct. The duct includes a merging portion, between the suction port and the exhaust port, for merging the air from the neighborhood of the fixing portion with the flow of the air by taking the air from the neighborhood of the fixing portion inside the duct. The recording material on which the image is fixed at the fixing portion is cooled by the air delivering through the exhaust port.

These and other objects, features and advantages of the present invention will become more apparent upon a consideration of the following description of the preferred embodiments of the present invention taken in conjunction with the accompanying drawings.

DESCRIPTION OF THE EMBODIMENTS

<Embodiment 1>

In the following, embodiments of the present invention will be described with reference to the drawings.

(1) Image Forming Portion

Figure 1A:
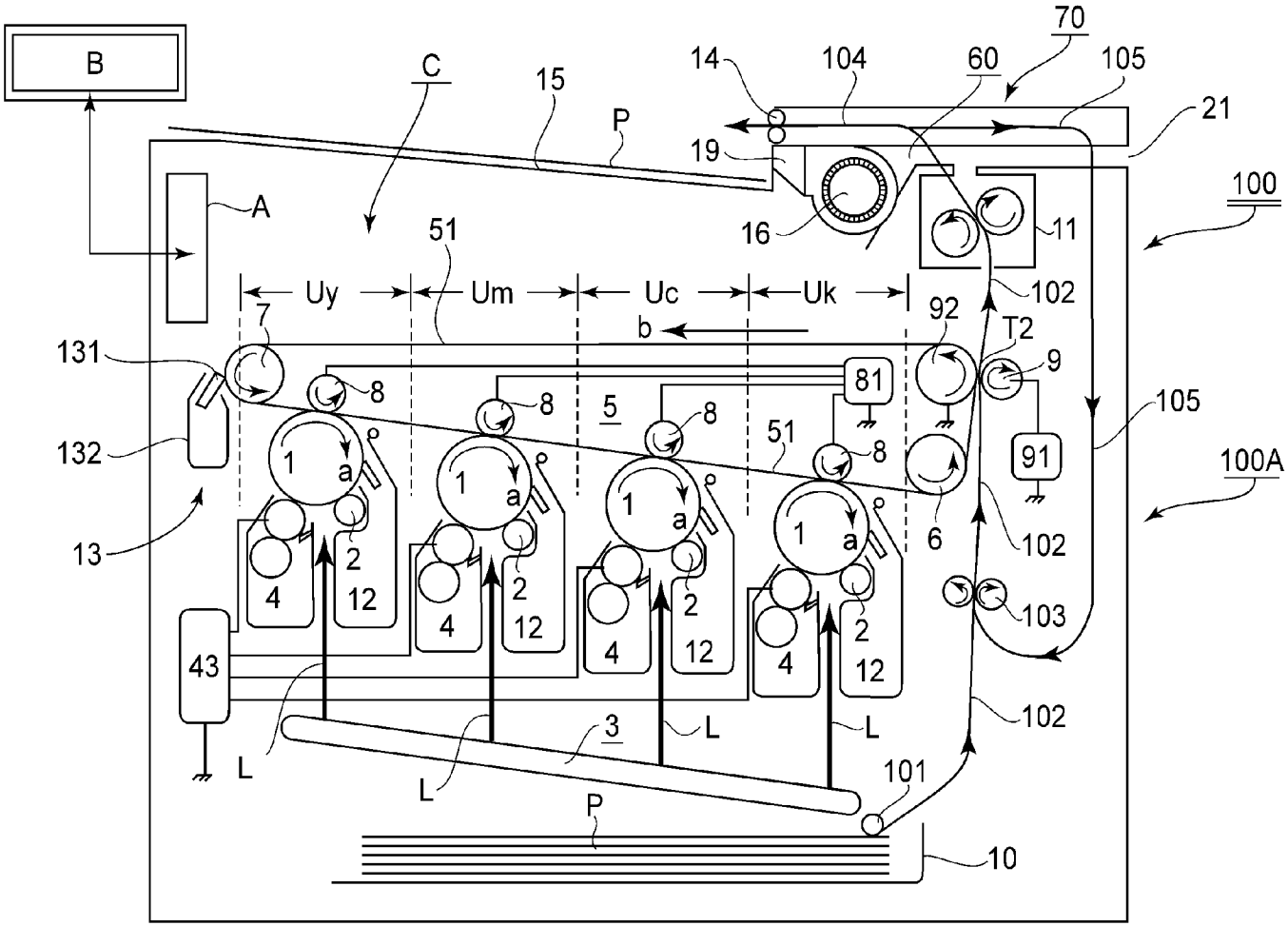
FIGS. 1A to 1C are schematic illustrations of an image forming apparatus in Embodiment 1.

FIG. 1A is a schematic longitudinal front view showing a schematic structure of an image forming apparatus 100 in this embodiment. This image forming apparatus 100 is a color laser beam printer of an electrophotographic type in which the process speed is 200 mm/sec and 35 ppm. That is, an image forming operation is performed depending on electrical image information inputted from an external host device B, such as a personal computer, into a control circuit portion A to form a full-color toner image or a monochromatic toner image on a recording material P, and then the recording material P is outputted as an image-formed product (print).

With respect to the image forming apparatus 100 and constituent members thereof, a front (surface) side refers to a front side with respect to a direction perpendicular to the drawing sheet of FIG. 1. A rear (surface) side refers to an opposite side to the front side. A left side or a right side is a left side or a right side as seen from the front side of the printer (image forming apparatus) 100, i.e., the left side or the right side with respect to a left-right direction on the drawing sheet of FIG. 1. An upper side or a lower side is an upper side or a lower side with respect to a direction of gravitation, i.e., the upper side or the lower side with respect to a vertical (up-down) direction on the drawing sheet of FIG. 1.

The recording material P is a sheet-like recording medium on which the toner image is to be formed, and includes, e.g., regular- or irregular-sized plain paper, thick paper, thin paper, an envelope, a postcard, a seal, a resin sheet, an OHP sheet and glossy paper. Hereinafter, the recording material is referred to as a sheet. Further, in the following, for convenience, the sheet (recording material) is described using a term such as sheet passing, sheet discharge sheet feeding and the like, but the sheet is not limited to the paper.

Inside an apparatus casing 100A of the image forming apparatus 100, an image forming portion (image forming means) C is provided. The image forming portion C includes an intermediary transfer belt unit 5, first to fourth (four) image forming units U (Uy, Um, Uc, Uk) and an exposure device 3 as a latent image forming means.

The belt unit 5 includes a secondary transfer opposite roller 92 and a driving roller 6, which are provided vertically in the right side of an inside of the apparatus casing 100A, and includes a supporting roller (tension roller) 7 provided in the left side. Further, the belt unit 5 includes a flexible and endless intermediary transfer belt 51 stretched among the three rollers 92, 6 and 7. The rollers 92, 6 and 7 are provided rotatably in the horizontal direction while having an axial direction which is a front-rear direction. The belt 51 is rotationally driven at a predetermined peripheral speed (200 mm/sec) in the counterclockwise direction of an arrow b by rotational driving of the roller 6.

A secondary transfer roller 9 is provided in parallel to the secondary transfer opposite roller 92 and is press-contacted to the belt 51 toward the secondary transfer opposite roller 92. A belt cleaner 13 includes a cleaning blade 131 provided counter-directionally in contact with a surface of the belt 51 at a portion where the belt 51 is wound around the roller 7.

The belt 51 has a single layer structure, as a belt structure, in which electroconductive particles are dispersed in a resin or rubber material to adjust the resistance value thereof. Further, it is also possible to use a belt having a structure of a plurality of layers such that a surface layer of a resin or rubber belt is coated with a fluorine-containing resin material such as PTFE, PFA or ETFE.

The first to fourth (four) image forming units (Uy, Um, Uc, Uk) are juxtaposed from the left side to the right side with predetermined intervals along a movement direction of a lower-side belt portion in a lower side of the belt 51. Below these four image forming units (Uy, Um, Uc, Uk), a laser beam scanner as an exposure device 3 is provided.

Figure 1B:
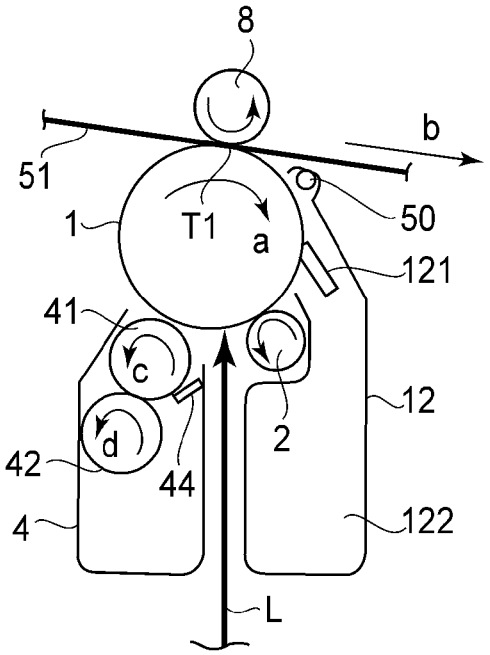

The image forming units Uy, Um, Uc and Uk are an electrophotographic process mechanism of a laser scanning exposure type and have the same basic structure except that colors of toners accommodated as developers in associated developing devices 4 are different from each other. FIG. 1B is a schematic enlarged view of one of the four image forming units in FIG. 1A.

Each image forming unit includes an electrophotographic photosensitive drum 1. Further, each image forming unit includes, as electrophotographic process means actable on the drum 1, a charging roller (charging means) 2, the developing device (developing means) 4, a primary transfer roller (primary transfer means) 8, and a drum cleaner (cleaning means) 12.

The drum 1 is provided horizontally with respect to an axial direction which is a front-rear direction, and is rotationally driven at a predetermined peripheral speed (200 mm/sec) in the clockwise direction of an arrow a. The charging roller 2 is disposed in parallel and contacts the drum 1, and uniformly charges the surface of the drum 1 to a predetermined polarity and a predetermined potential by being supplied with a high voltage of AC+DC or DC while being rotated by rotation of the drum 1. The uniformly charged surface of the drum 1 is exposed to laser light L by scanning with the scanner 3, so that an electrostatic latent image corresponding to a scanning exposure pattern is formed on the drum surface.

The developing device 4 is a one-component non-magnetic contact developing device using a one-component non-magnetic toner as the developer. The developing device 4 includes a developing roller 41, which is a developer carrying member for forming a developing nip with the drum 1. Further, the developing device 4 includes a developer supplying roller 42, which is a developer supplying means for applying the toner onto the surface of the developing roller 41. Further, the developing device 4 includes a regulating blade 44 for regulating a toner layer thickness on the developing roller 41 while contact-charging the toner simultaneously.

As the toner, a toner was used in which a styrene-acrylic resin is a main component and to this main component, a charge control component, silica and the like are internally or externally added as desired, and the glass transition temperature (Tg) is about 58° C. The developing roller 41 uniformly surface-coated with the toner is lightly press-contacted to the drum 1, and is rotationally driven in an arrow c direction (counterclockwise direction), which is the same direction as the rotational direction of the drum 1 while providing a difference in speed from the rotating drum 1. A predetermined DC voltage is applied from a developing high-voltage source 43 to the developing roller 41, whereby the latent image on the drum 1 is visualized (developed) as a toner image (developer image).

The toner supplying roller 42 is rotationally driven in an arrow d direction (counterclockwise direction) so as to slide with the developing roller 41 in an opposite direction to the rotational direction of the developing roller 41. To this toner supplying roller 42, by applying a predetermined DC voltage from a high-voltage source (not shown), toner supply to and toner collection from the developing roller 41 are controlled.

In the first image forming unit Uy, y (yellow) toner is accommodated in the developing device 4, and a y toner image is formed on the drum 1. In the second image forming unit Um, m (magenta) toner is accommodated in the developing device 4, and an m toner image is formed on the drum 1. In the third image forming unit Uc, c (cyan) toner is accommodated in the developing device 4, and a c toner image is formed on the drum 1. In the fourth image forming unit Uk, k (black) toner is accommodated in the developing device 4, and a k toner image is formed on the drum 1.

In each image forming unit, a primary transfer roller 8 is provided inside the belt 51, and is disposed in parallel to the associated drum 1 via the lower-side belt portion of the belt 51 and is press-contacted to the belt 51. A contact portion (nip) between each drum 1 and the belt 51 is a primary transfer portion T1.

The toner image, on the drum surface, developed by the developing device 4 in each image forming unit is fed to the primary transfer portion T1 by the rotation of the drum 1. To the primary transfer roller 8, a predetermined primary transfer voltage is applied from a primary transfer high-voltage source 81. As a result, a transfer electric field is formed at the primary transfer portion. Then, the toner image which reached the primary transfer portion T1 with the rotation of the drum 1 is transferred by the action of this transfer electric field onto the surface of the belt 51 rotating in the same direction as the rotational direction of the drum 1.

The primary transfer roller 8 in this embodiment is prepared by forming, in a roller shape, a layer of EPDM rubber on a peripheral surface of a metal core. Further, the voltage from the primary transfer high-voltage source 81 is applied to the metal core. In this embodiment, as a primary transfer member, the roller-shaped member is used, but it is possible to use even members formed in a sheet shape, a blade shape and a brush shape.

A transfer residual toner on the drum 1 is removed by a cleaning blade 121 of the drum cleaner 12. The transfer residual toner removed from the surface of the drum 1 is accommodated in a residual toner container 122.

A charged state of the drum 1 after the primary transfer is unstable by the influence of the presence or absence of the toner image and the primary transfer high-voltage. Therefore, in this embodiment, the surface of the drum 1 after the primary transfer is subjected to whole surface exposure by a whole area exposure device (eraser lamp) 50 using an LED or the like to remove electric charges. As a result, the charged state of the charging roller is stabilized, so that uniform charging can be made.

Thus, the respective color toner images of y, m, c and k formed on the drum surfaces in the first to fourth image forming units Uy, Um, Uc and Uk pass through the associated primary transfer portions T1 and are successively primary-transferred superposedly onto the surface of the moving belt 51. As a result, on the surface of the belt 51 passed through the primary transfer portion T1 of the fourth image forming unit Uk, an unfixed full-color toner image is synthetically formed by superposition of the above-described four color toner images.

In the belt unit 5, the driving roller 6 and the supporting roller 7 are in an electrically float state or are supplied with a high-voltage similar to the primary transfer high-voltage. Further, the resistance value of the secondary transfer opposite roller 92 is adjusted to $1\times10^6$ Ω or less, and the secondary transfer opposite roller 92 is grounded.

Below the scanner unit 3, a sheet feeding portion 10 in which sheets P are stacked and accommodated is provided. In the right side of the sheet feeding portion 10, a sheet feeding mechanism 101 for separating and feeding the sheets P one by one from the sheet feeding portion 10 is provided. Further, in the right side of an inside of the apparatus casing 100A, a vertical feeding path 102 directed from the lower side toward the upper side in the apparatus casing is provided. The vertical feeding path 102 is constituted by a plurality of guiding plate and a relay feeding roller pair and the like although these members are omitted from illustration.

At the position of a lower end portion of the vertical feeding path 102, the sheet feeding mechanism 101 described above is disposed. At the position of an upper end portion of the vertical feeding path 102, i.e., at the position of an upper-right portion of the inside of the apparatus casing 100A, a fixing device (fixing means) 11 is provided. Further, at predetermined halfway positions of the vertical feeding path 102 extending from the sheet feeding mechanism 101 to the fixing device 11, a registration roller pair 103 and a secondary transfer portion T2 are successively provided.

At a predetermined sheet feeding control timing, the sheet feeding mechanism 101 is driven. As a result, one of the sheets P in the sheet feeding portion 10 is separated and fed, and is passed through the vertical feeding path 102 to be fed to the registration roller pair 103. The registration roller pair 103 feeds the sheet P at a predetermined timing so that a leading end of the sheet P reaches the secondary transfer portion T2 in synchronism with timing when a leading end of the full-color toner image formed on the surface of the belt 51 as described above reaches the secondary transfer portion T2.

At the timing when the sheet P reaches the secondary transfer portion T2, a predetermined high-voltage is applied from a secondary transfer high-voltage source 91 to the secondary transfer roller 9. The secondary transfer roller 9 is prepared, similarly as the primary transfer roller 8, by forming a layer of EPDM rubber in a roller shape on a peripheral surface of a metal core. Further, similarly as the primary transfer roller 8, the voltage from the secondary transfer high-voltage source 91 is applied to the metal core. By the action of the secondary transfer voltage, a secondary transfer current flows from the secondary transfer roller 9 to a path consisting of the sheet P, the belt 51 and the secondary transfer opposite roller 92, so that an electric field necessary for the secondary transfer is formed.

As a result, the full-color toner image is successively secondary-transferred collectively from the belt 51 onto a belt opposing surface of the sheet P nip-fed through the secondary transfer portion T2. The sheet P coming out of the secondary transfer portion T2 is separated from the belt 51 by the curvature of the secondary transfer opposite roller 92, and then is fed to the fixing device (fixing portion) 11. A transfer residual toner on the belt 51 after the secondary transfer is removed by a cleaning blade 131 of the belt cleaner 13. The removed transfer residual toner is accommodated in a residual toner container 132.

Figure 1C:
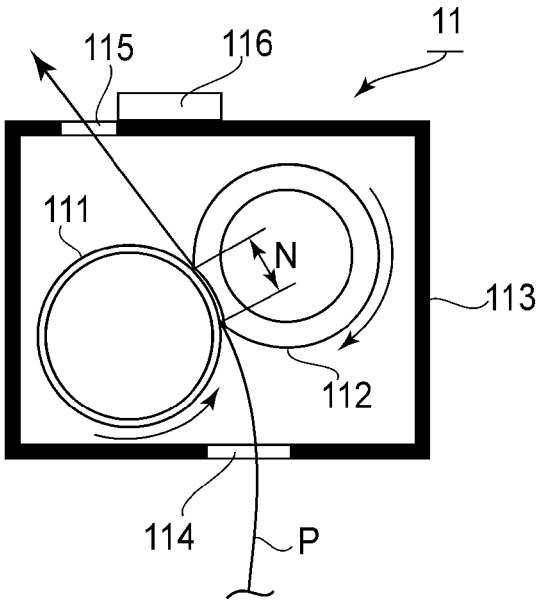

The fixing device 11 heat-fixes the toner image, as a fixed image, carried on the sheet P. FIG. 1C is a schematic enlarged view of a portion of the fixing device 11 in FIG. 1A. The fixing device 11 includes a fixing sleeve 111 as a rotatable heating member and an elastic pressing roller 112 as a rotatable pressing member which are two parallel rollers which are provided so that the rotational axis directions thereof are the front-rear direction and which are press-contacted to each other to form a fixing nip N, and includes a fixing device casing 113 in which these members 111 and 112 are accommodated. The fixing device casing 113 is provided with slit-like sheet entrance portion 114 and a slit-like sheet exit portion 115 which extend in the front-rear direction in the lower side and the upper side, respectively, thereof.

As the fixing sleeve 111, a sleeve prepared by forming a 200 μm-thick silicone rubber layer (elastic layer) on an endless belt formed of SUS in a cylindrical shape of 24 mm in inner diameter, 30 μm in thickness and 240 mm in length, and then by coating the silicone rubber layer with a 20 μm-thick PFA resin tube (parting layer) was used.

As a base layer of the fixing sleeve 111, a layer formed of a resin material such as PTFE, PFA, PPS, PI, PAI, PEEK or PES in a cylindrical shape can be used. Further, it is possible to use a layer formed of metal such as nickel (Ni), iron (Fe), stainless steel (SUS), copper (Cu), nickel-cobalt (Ni—Co) alloy, permalloy (Fe-Ni alloy) in a cylindrical shape.

Further, the parting layer of the fixing sleeve 111 is provided for the purpose of improving the parting property of the sleeve surface. As a material therefor, a coating film or a tube of a fluorine-containing resin material such as PTFE, PFA, FEP or the like can be used, but in this embodiment, a PFA tube film capable of forming a uniform fluorine-containing resin layer was used.

As the pressing roller 112, a roller prepared by forming an about 4 mm-thick silicone rubber layer as an elastic layer on a metal core formed of a stainless steel in an outer diameter of 17 mm, and then by coating the silicone rubber layer with an about 50 μm-thick PFA resin tube as a parting layer to provide a roller portion of about 25 mm in outer diameter was used.

In the fixing device 11 in this embodiment, the pressing roller 112 is rotationally driven in a sheet feeding direction, and the fixing sleeve 111 is rotatably by the rotation of this pressing roller 112. Inside the fixing sleeve 111, a heating source (not shown) for heating the fixing sleeve is provided.

The sheet P fed from the secondary transfer portion T2 to the fixing device 11 enters the fixing device 11 through the lower-side sheet entrance portion 114 of the fixing device casing 113 to reach and enter the fixing nip N, so that a toner image-carrying surface of the sheet P contacts the fixing sleeve 111 and then the sheet P is fed from below to above. In a process in which the sheet P is nipped and fed through the fixing nip N, the toner images on the sheet P are melted and color-mixed, and thus are heat-fixed as a fixed image.

The sheet P coming out of the fixing nip N is sent, from below to above, to the outside of the fixing device 11 through the upper-side sheet exit portion 115 of the fixing device casing 113, and then is sent leftward through a horizontal feeding path 104 of a feeding path unit 70 provided at an upper portion of the apparatus casing 100A. Then, the sheet P is discharged onto a sheet discharge tray 15, provided at an upper surface of the apparatus casing 100A, by a discharging roller pair 14 (discharging portion) so that an image surface is directed downward (face down) (one-side print mode). In the case of a continuous print operation, the sheets P sequentially passing through the fixing device 11 are successively discharged and stacked on the sheet discharge tray 15.

In the case of a monochromatic print mode, only the fourth image forming unit Uk for forming the black toner image is subjected to control of the image forming operation. In the case where a double-side print mode is selected, as described above, the sheet P which has already been subjected to the one-side print is sent onto the sheet discharge tray 15 by the sheet discharging roller pair 14, and then at the time immediately before a trailing end portion of the sheet P completely passes through the sheet discharging roller pair 14, the driving of the sheet discharging roller pair 14 is reversed in rotational direction. As a result, the sheet P is fed rightward along the horizontal feeding path 104 in a switch-back feeding manner and then is guided into a feeding path 105 for re-feeding.

The feeding path 105 for re-feeding is constituted by a plurality of guiding plates, a relay feeding roller pair and the like although these members are omitted from illustration, and communicates with the vertical feeding path 102 in a side upstream of the registration roller pair 103 with respect to the sheet feeding direction. The sheet P guided in the feeding path 105 for re-feeding is turned upside down and then is fed again to the registration roller pair 103. Thereafter, similarly as in the case of the one-side print of the sheet P, the sheet P passes through the path consisting of the second transfer portion T2, the fixing device 11, the horizontal feeding path 104 and the discharging roller pair 14, and then is sent, as a double-side image-formed product, onto the sheet discharge tray 15.

(2) Air-Sending Path

The image forming apparatus 100 in this embodiment is provided with an air-sending path 60 along which ft water (content)-containing air generated by heating the sheet P in the fixing device 11 is sucked and then is delivered toward a portion of the sheet discharge tray 15. As a result, generation of discharged sheet sticking is prevented by cooling the sheet P discharged onto the sheet discharge tray 15 with the delivered air to lower the temperature of the toner image, and at the same time, the generation of improper orientation of the sheets P is prevented by removing the electric charges from the sheets P by the water content of the delivered air. In this case, a device is provided for alleviating the temperature rise of a fan 16 as an air-sending means of the air-sending path 60 and a lowering in delivered air cooling performance by enabling a lowering in temperature of the air sucked from the fixing device 11.

This will be described below. In the image forming apparatus 100 in this embodiment, the air-sending path 60 described above is disposed, in the apparatus casing 100A, between the upper side of the fixing device 11 and the lower side of the feeding path unit 70 including the horizontal feeding path 104, the discharging roller pair 14 and a part of the feeding path 105 for re-feeding in the upper side.

Figure 2:
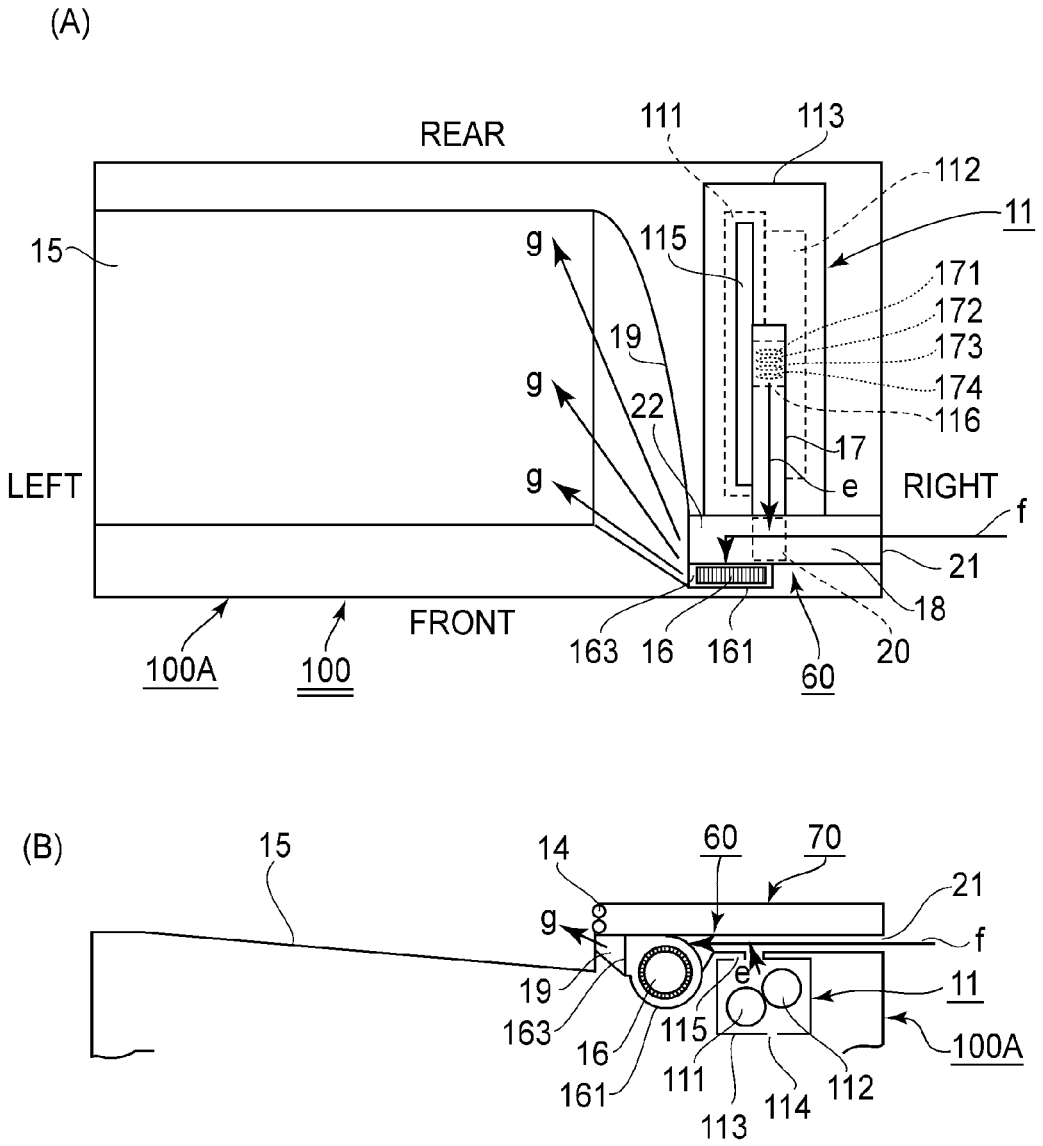
In FIG. 2, (A) and (B) are illustrations of an air-sending path.
Figure 3:
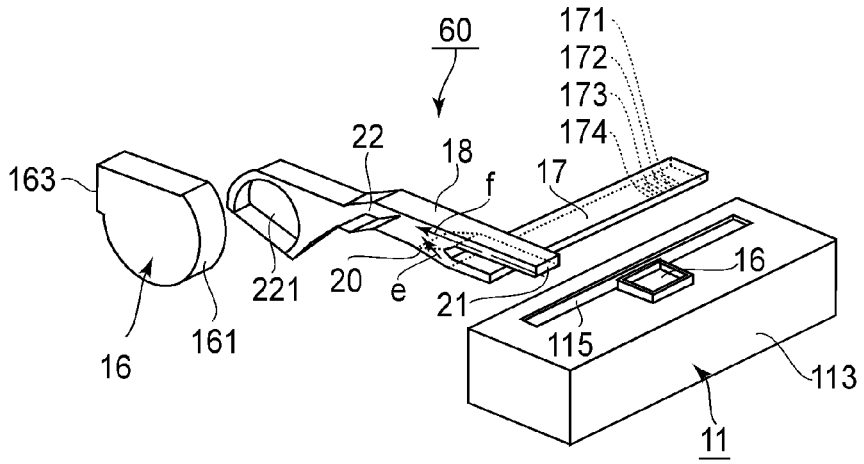
In FIG. 3, (A) and (B) are illustrations of the air-sending path.
Figure 3:
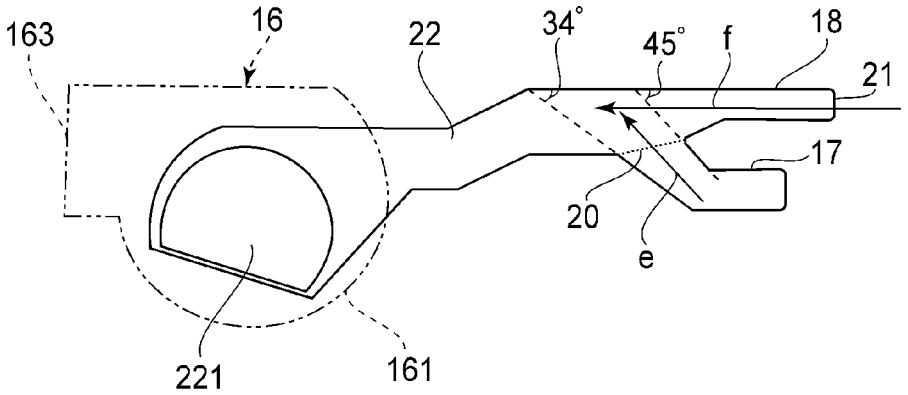

In FIG. 2, (A) is a cut-away top view of the printer (image forming apparatus) 100 when a portion of the feeding path unit 70 is omitted and the air-sending path 60 is seen, and (B) is a schematic longitudinal front view of an upper portion of the image forming apparatus 100. In FIG. 3, (A) is an exploded perspective view of the air-sending path 60, and (B) is a front view of the air-sending path 60. In FIGS. 2 and 3, the flow of the air in the air-sending path 60 is shown by arrows.

The air-sending path 60 includes a second duct 17 in which the water-containing air generated by heating the introduced sheet P in the fixing device 11 is sucked, and a first duct in which the air lower in temperature than the air in the second duct is sucked. The air-sending path 60 further includes the fan 16 as an air-sending means for delivering the air, sucked through the second duct 17 and the first duct 18, toward the sheet discharge tray 15.

In this embodiment, the second duct 18 is an elongated flat duct disposed and extending horizontally from the front side of the inside of the apparatus casing 100A to a position substantially central portion of the fixing device 11 with respect to a longitudinal direction of the fixing device 11 in the upper side of the fixing device 11. The second duct 17 is long along the longitudinal direction of the fixing device 11. At a lower surface of the duct 17 in a free end portion side, second suction ports 171, 172, 173 and 174 are provided. The second suction ports 171 to 174 oppose a cylindrical hole portion 116 provided at a substantially central portion of the casing 113 with respect to a longitudinal direction of the casing 113 in an upper surface side of the casing 113 of the fixing device 11.

The first duct 18 is positioned on a side higher than the second duct 17, and is an elongated flat duct disposed and stretched horizontally in the left-right direction in the front side of the inside of the apparatus casing 100A. A right-side end portion of this first duct 18 is open, as a first suction port 21, to the outside of the image forming apparatus at a position of a right side plate of the apparatus casing 100A.

Further, the second duct 17 merges with the first duct 18 between the first suction port 21 and an exhaust port 221 of the first duct 18. A connecting portion (merging portion) 20 connects (merges) the second duct 17 and the first duct 18. After both of the second duct 17 and the first duct 18 are merged with each other, a merged duct portion 22 (a part of the first duct) remains. With respect to the exhaust port 221 of the merged duct portion 22, the fan 16 is disposed so that a suction portion 162 of a fan housing portion 161 communicates with the exhaust port 221. That is, the duct is connected to the suction portion 162 after the second duct 17 and the first duct 18 are merged with each other. Incidentally, the first suction port 21 and the exhaust port 221 are provided opposite from each other with respect to a recording material discharging direction at the discharging roller pair 14.

With respect to the fan 16, an exhaust duct (air-sending path to the sheet P) 19 for guiding the delivered air from the fan 16 to the sheet discharge tray 15 is provided and connected to an exhaust portion 163 of the fan housing portion 161. The exhaust duct 19 is provided and extends along a longitudinal direction of the sheet discharging roller pair 14 in the lower side of the sheet discharging roller pair 14 in the feeding path unit 70, and is open toward the sheet discharge tray 15 over a full-length area.

In this embodiment, as the fan 16, a multiblade fan of 3100 rpm in rotational speed during input of a DC voltage of 24 V, 0.3 $m^3$/min in maximum airflow rate, and -10° C. to 70° C. in operable temperature was used. The fan 16 is turned on during the image forming operation of the printer 100. This fan 16 is driven, whereby high-temperature air, containing water content, generated by heating the sheet P in the fixing device 11 is sucked (arrow e) from the inside of the fixing device casing 113 to the inside of the second duct 17 through the second suction ports 171 to 174 of the second duct 17. By this sucked air e, the fixing device 11 is suction-cooled.

Further, the air, outside the image forming apparatus, lower in temperature than the air sucked through the second duct 17 is sucked (arrow f) through the suction port 21.

Then, the sucked air e through the second duct 17 and the sucked air f through the first duct 18 are merged with each other at the duct merging portion 20, so that the sucked high-temperature air e from the second duct 17 is lowered in temperature by mixing thereof with the sucked low-temperature air f from the first duct 17. Accordingly, the fan 16 sucks the merged air lowered in temperature and then exhausts the merged air toward the sheet discharge tray 15 through the exhaust duct 19.

The air delivered through the exhaust duct 19 flows toward the sheet discharge tray 15 in arrow g directions shown in FIG. 2 in the exhaust duct 19, and is discharged to the outside of the printer 100. By this delivered air g, the sheet P is cooled by the action of the delivered air on the image surface thereof discharged in midstream from the sheet discharging roller pair 14 to the sheet discharge tray 15 and on the sheet P which have already been discharged on the sheet discharge tray 15. Further, the delivered water-containing air g blows against the sheet P, so that the electric charges of the sheet P are removed. A constitution in which the delivered air g blows against the sheet P before the sheet P is discharged by the sheet discharging roller pair 14 may also be employed. That is, the delivered air g may only be required to be capable of cooling the sheet P on which the toner image is fixed by the fixing device 11.

Accordingly, it is possible to prevent the generation of the discharged sheet sticking and the improper orientation of the sheets P on the sheet discharge tray 15. Further, the sucked air temperature of the fan 16 as the air-sending means in the air-sending path 60 is lowered, so that the temperature rise of the fan 16 and the lowering in delivered air cooling performance of the fan 16 are alleviated. Further, the sucked air temperature of the fan 16 is lowered, and therefore even when a fan relatively low in heat-resistant temperature and durable performance is used as the fan 16, the life of the fan 16 can be ensured, so that it becomes possible to reduce the cost. The fixing device 11 is cooled by suction of the air through the duct 17.

Next, the shapes of and the rate of airflow of the air passing through the second duct 17, the first duct 18, the duct connecting portion 20 and the first suction port 21 will be described with reference to (B) of FIG. 3. As shown in (B) of FIG. 3, the second duct 17 as seen from the front surface is connected to the first duct 18 at the duct connecting portion 20 at an angle of 34 - 45° when an angle of the upper surface of the first duct 18 is taken as 0° as a reference. That is, the air-sending path is provided so that an angle h of a flow (speed vector) e of the air passing through the second duct 17 relative to the flow (speed vector) f of the air passing through the first duct 18 is 34 - 45° and so that the center value of the angle h is 39.5°.

In order to check the flow of the air in the duct, in a state in which the fan 16 is operated, an airflow rate was measured at the duct connecting portion 20 and the first suction port 21. The airflow rate was measured using an airflow temperature sensor ("UAS-1000", manufactured by Degree Controls, Inc.) in a state in which a voltage of +24 V was supplied to the fan 16. Further, the rate of the flow of the air passing through each of the duct connecting portion 20 and the first suction port 21 was calculated by multiplying an area of the inside of the duct with respect to a direction perpendicular to the airflow vector at an airflow rate measuring portion by a measured airflow rate, and these values are shown in Table 1.

TABLE 1

| | AREA | WIND SPEED | AIRFLOW RATE |
|---|---|---|---|
| DCP*1 20 | 88 $mm^2$ | 1.5 m/s | 0.008 $m^3$/min |
| FSP*2 21 | 140 $mm^2$ | 6.0 m/s | 0.05 $m^3$/min |

*1"DCP" is the duct connecting portion.

*2"FSP" is the first suction port.

As shown in Table 1, it was confirmed that the rate of the flow of the air, from the outside of the image forming apparatus, passing through the first duct 18 via the first suction port 21 is larger than the rate of the flow of the air, from the fixing device 11, passing through the inside of the second duct 17.

(3) Confirmation of Effect

An effect of this embodiment will be described below. For comparison, printing was carried out also with respect to an image forming apparatus using a comparative constitution, and an effect against fan temperature rise and discharged sheet sticking was confirmed.

Comparison Example 1

Figure 4:
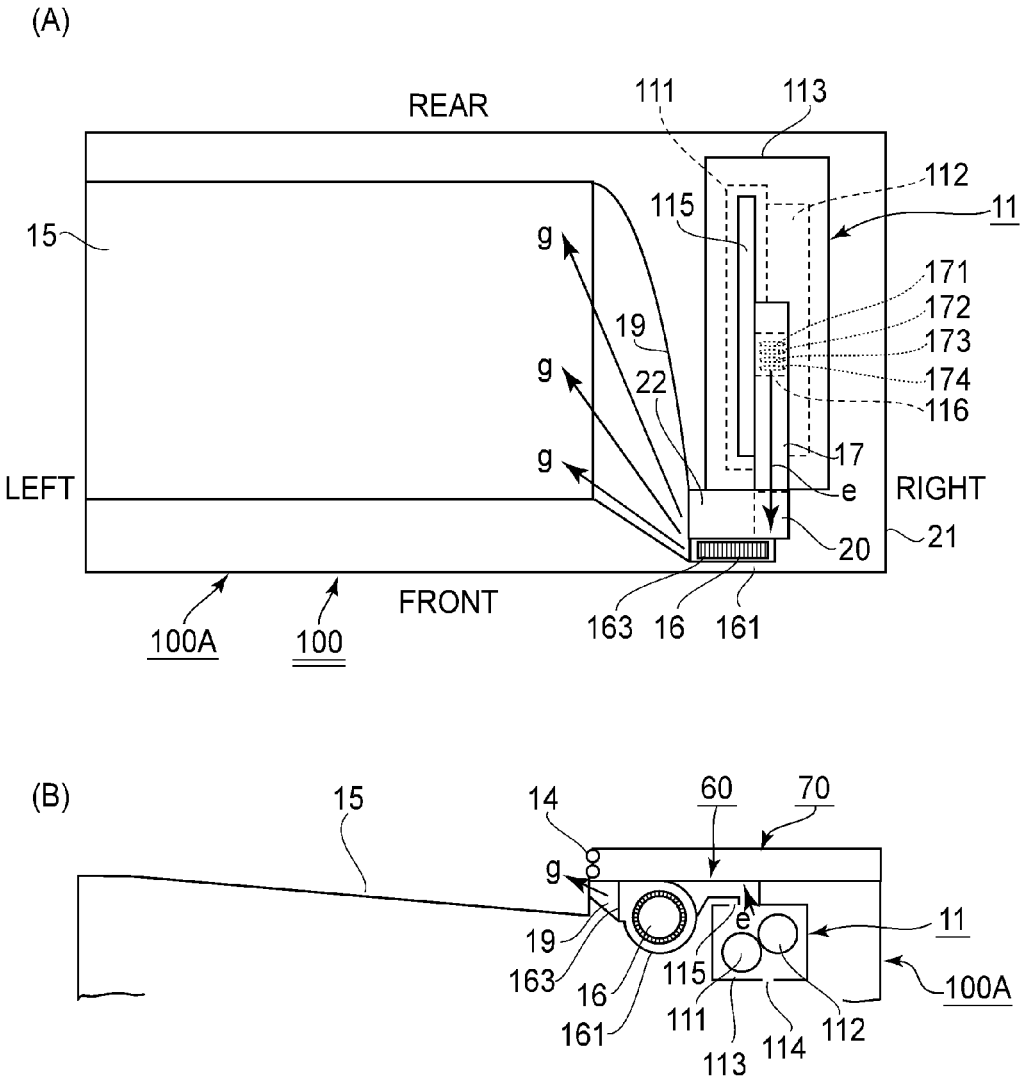
In FIG. 4, (A) and (B) are illustrations of an air-sending path in Comparison Example.

As the comparative constitution relative to Embodiment 1, a constitution in Comparison Example 1 was shown in FIG. 4. As the constitution in Comparison Example 1, compared with the image forming apparatus 100 in Embodiment 1, a constitution in which there is no first duct 18, i.e., a constitution in which the air outside the image forming apparatus cannot be sucked was used. Other constituent elements are the same as those of the image forming apparatus 100 in Embodiment 1.

A condition during confirmation of the effect will be described below. The condition of the temperature and the humidity in an operation (use) environment was 23° C. in temperature and 50% RH in humidity. Further, as the sheet P, A3-sized paper ("CF-0081", available from Canon K.K.) was used, and double-side printing of 150 sheets each on which a solid black image was formed with a margin of 5 mm in each of four (upper, lower, left and right) sides was made. In order to check the fan temperature rise, a thermocouple was bonded to each of the suction ports 171 - 174, the suction port 21 and the housing portion 161 of the fan 16, and then a highest end-point temperature during the printing at each of the portions was monitored.

Further, as a means for checking the discharged sheet sticking performance, the presence or absence of the sticking of the sheet P before and after the sheets P on which the image was printed were stacked was checked. Further, as an index of a performance against the discharged sheet sticking, a temperature of the air delivered from the exhaust duct 19 at the time of an end of the printing was monitored by the thermocouple. An evaluation result of the constitution in Embodiment 1 and the comparative constitution in Comparison Example 1 is shown in Table 2.

TABLE 2

| | TEMP. AT 171-174 | TEMP. AT 21 | FAN TEMP. | ET*1 | DSS*2 |
|---|---|---|---|---|---|
| EMB. 1 | 72° C. | 23° C. | 39° C. | 38° C. | NO |
| COMP.EX. 1 | 72° C. | 23° C. | 52° C. | 48° C. | YES |

*1"ET" is an delivered air temperature.
*2"DSS" is the presence or absence of the discharged sheet sticking.

As shown in Table 2, by the constitution in Embodiment 1, it was possible to suppress the temperature rise of the fan 16 by 13° C. relative to the comparative constitution in Comparison Example 1 while eliminating the discharged sheet sticking generating in the comparative constitution in Comparison Example 1. As described above, by providing the air-sending path, as the constitution in this embodiment, capable of sucking the air lower in temperature than the air sucked through the air-sending path from the fixing device 11, it was possible to compatibly realize the suppression of the fan temperature rise and the performance against the discharged sheet sticking.

Comparison Example 2

As other comparative constitutions, the image forming apparatus 100 in Embodiment 1 was used and sizes of the second suction ports 171 - 174 of the second duct 17 and the first duct 21 of the first duct 18 were changed, so that the relationship of magnitudes of rates of the air passing through the ducts and the relationship of the performance were studied. In the case where the rate of the air flowing inside the second duct 17 exceeds the rate of the air flowing inside the first duct 18, it would be considered that the temperature of the air sucked by the fan 16 becomes high and thus the performance against the discharged sheet sticking is lowered by the fan temperature rise and the delivered air temperature rise.

On the basis of the above consideration, as Comparison Example 2, comparison verification was made using duct constitutions shown in Table 3 below. In the constitution in Comparison Example 2, under a condition such that a total rate of the flow of the air passing through the second duct 17 and the first duct 18 is uniformized to about 0.06 $m^3$/min., the sizes of the second suction ports 171-174 of the second duct 17 and the first suction port 21 of the first duct 18 are changed. In this way, the magnitude relationship of the rates of the flow of the air passing through the ducts 17 and 18 and the relationship of the performance were studied.

TABLE 3

| CONSTITUTION | MP*3 | SPA*4 ($mm^2$) | MPA*5 ($mm^2$) | WS*2 (m/s) | AFR*1 ($m^3$/min) | FT*6 (° C.) | DSS*7 | EAT*8 (° C.) |
|---|---|---|---|---|---|---|---|---|
| EMB. 1 | | | | | | | | |
| AFR*1: DUCT 18 > DUCT 17 | 20 | 80 | 88 | 1.5 | 0.008 | 39 | NO | 38 |
| WS*2: DUCT 18 > DUCT 17 | 21 | 140 | | 6.0 | 0.05 | | | |
| COMP. EX. 2(1) | | | | | | | | |
| AFR*1: DUCT 18 > DUCT 17 | 20 | 180 | 88 | 5.2 | 0.027 | 42 | NO | 40 |
| WS*2: DUCT 18 > DUCT 17 | 21 | 100 | | 5.0 | 0.03 | | | |

TABLE 3-continued

| CONSTITUTION | MP*3 | SPA*4 ($mm^2$) | MPA*5 ($mm^2$) | WS*2 (m/s) | AFR*1 ($m^3$/min) | FT*6 (° C.) | DSS*7 | EAT*8 (° C.) |
|---|---|---|---|---|---|---|---|---|
| COMP. EX. 2(2) | | | | | | | | |
| AFR*1: DUCT 18 > DUCT 17 | 20 | 200 | 88 | 6.2 | 0.033 | 48 | YES | 44 |
| WS*2: DUCT 18 > DUCT 17 | 21 | 80 | | 4.7 | 0.025 | | | |

*1"AFR" is the airflow rate.
*2"WS" is the wind speed.
*3"MP" is the measured portion.
*4"SPA" is suction port area.
*5"MPA" is the measured portion area.
*6"FA" is the fan temperature.
*7"DSS" is the discharged sheet stichking.
*8"EAT" is the exhausted air temperature.

In the constitution of Comparison Example 2(1), the area of the first suction port 21 is reduced, and the area of each of the second suction ports 171 - 174 is enlarged, so that the wind speed is (first duct 18)<(second duct 17), which is different from that in Embodiment 1. However, the airflow rate magnitude relationship was (first duct 18)>(second duct 17), which is the same as that in Embodiment 1.

Further, in the constitution of Comparison Example 2(2), the area of the first suction port 21 was further reduced compared with that in Comparison Example 2(1), and the area of each of the second suction ports 171 - 174 was enlarged, so that the wind speed magnitude relationship was changed to (the first duct 18)<(second duct 17), which is different from those in Embodiment 1 and the Comparison Example 2(1).

As a result of execution of a performance comparison using these constitutions, no discharged sheet sticking is generated in Comparison Example 2(1). On the other hand, the discharged sheet sticking is generated in Comparison Example 2(2). That is, it was confirmed that in the case where the rate of the flow of the air flowing inside the second duct exceeded the rate of the flow of the air flowing inside the first duct, the performance against the discharged sheet sticking was lowered by the fan temperature rise and the delivered air temperature rise. Accordingly, in order to compatibly realize the suppression of the fan temperature rise and the performance against the discharged sheet sticking while maintaining the performance of the suction of the air from the fixing device 11, it is desirable that the flow rate of the air flowing inside the first duct 18 is larger than (exceeds) the flow rate of the air flowing the inside of the second duct 17.

Comparison Example 3

As another comparative constitution, the image forming apparatus in Embodiment 1 was used, and the relationship between the angle h ((B) of FIG. 3) of the flow of the air passing through the second duct 17 relative to the flow of the air passing through the first duct 18 and the performance was studied. In the case of the angle h>90°, it would be considered that the flow f of the air in the first duct 18 has the action of preventing the flow e of the air in the second duct 17 by flowing into the second duct 17, and therefore the air suction performance from the fixing device 11 is lowered.

Figure 5:
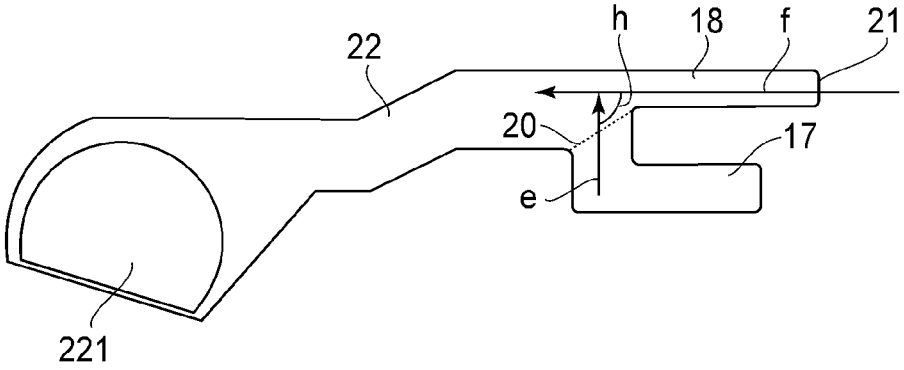
In FIG. 5, (A) and (B) are illustrations of a duct shape.
Figure 5:
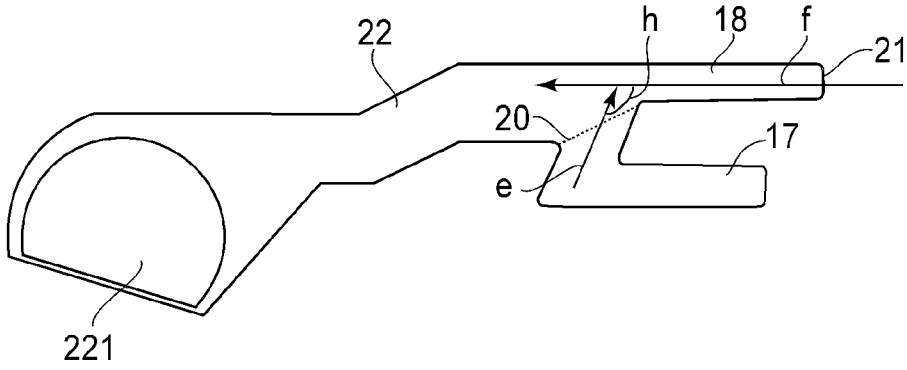

On the basis of the above consideration, as Comparison Example 3, a comparison verification was made using a constitution of h=90° shown in (A) of FIG. 5 and a constitution of h=113° shown in (B) of FIG. 5.

In the constitutions of Comparison Example 3, similarly as Embodiment 1, the wind speed was measured at the duct connecting portion 20 and the first suction port 21, and the area inside the duct with respect to a direction perpendicular to the speed vector of the flow of the air at each of the wind speed measuring portions was multiplied by the measured wind speed. In this way, the rate of the flow of the air passing through each of the duct connecting portion 20 and the first suction port 21 was calculated, and these values are shown in Table 4 below. In the duct in the constitution of Comparison Example 3, the area of the inside of the duct with respect to the direction perpendicular to the air flowing direction was 88 $mm^2$ similarly as in Embodiment 1.

TABLE 4

| CONSTITUTION | MP*1 | AREA ($mm^2$) | WS*2 (m/s) | AFR*3 ($m^3$/min) |
|---|---|---|---|---|
| EMB. 1 | 20 | 88 | 1.5 | 0.008 |
| h = 39.5° | 21 | 140 | 6.0 | 0.05 |
| COMP.EMB. 3 | 20 | 88 | 1.5 | 0.008 |
| h = 90° | 21 | 140 | 6.0 | 0.05 |
| COMP.EMB. 3 | 20 | 88 | 1.1 | 0.006 |
| h = 113° | 21 | 140 | 6.0 | 0.05 |

*1"MP" is the measuring portion, i.e., the duct connecting portion 20 or the first suction port 21.
*2"WS" is the wind speed.
*3"AFR" is the airflow rate.

In the constitution of h=90° in Comparison Example 3, there was no difference in wind speed and airflow rate between itself and the constitution in Embodiment 1, but in the constitution of h=113° in Comparison Example 3, the wind speed and the airflow rate of the air passing through the duct connecting portion 20 and flowing inside the second duct 17 were lower than those in the constitution of h=90° in Comparison Example 3.

That is, it was confirmed that in the case where the airflow vector (speed vector) inside the second duct 17 has the angle of more than 90° relative to the airflow vector (speed vector) inside the first duct 18, the air suction performance from the fixing device 11 was lowered.

That is, in order to compatibly realize the fan temperature rise suppression and the performance against the discharged sheet sticking while maintaining the air suction performance from the fixing device 11, it is desirable that the angle h of the second duct 17 relative to the first duct 18 is 90° or less.

(4) Other Embodiments

1) In Embodiment 1, in the air suction side of the fan 16, the constitution in which the two ducts consisting of the first duct 18 and the second duct 17 are connected with each other is used, but a functional effect similar to that in Embodiment 1 can be obtained even when the number of ducts is increased for the purpose of cooling the sucked air at another portion.

2) In Embodiment 1, the constitution in which only the exhaust duct 19 is used in the air exhaust side of the fan 16 is used, but a functional effect similar to that in Embodiment 1 can be obtained even when the number of ducts is increased. That is, the effect of Embodiment 1 can be obtained irrespective of the number of ducts which are the air-sending paths.

3) In Embodiment 1, the multiblade fan is used as the fan 16, but a functional effect similar to that in Embodiment 1 can be obtained even when an axial fan or another air-sending means capable of sucking and delivering the air. That is, the effect of Embodiment 1 can be obtained irrespective of the species of the fan.

4) In Embodiment 1, the air is sucked from the outside of the image forming apparatus 100 through the first duct 18 which is the second suction port, but when the air lower in temperature than through the first duct 18, a constitution in which the air at an appropriate portion inside the image forming apparatus 100 is sucked may also be employed.

5) The image forming portion C of the image forming apparatus 100 is not limited to that of the electrophotographic type. The image forming portions of an electrostatic recording type and a magnetic recording type may also be used. Further, the image forming portion C is not limited to that of the transfer type, but a constitution in which the toner image is directly formed on the recording material may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 232107/2013 filed Nov. 8, 2013, which is hereby incorporated by reference.

What is claimed is:

1. An image forming apparatus for forming an image on a recording material, said image forming apparatus comprising:

a fixing portion configured to heat-fix the image on the recording material while conveying the recording material bearing the image at a nip portion, said fixing portion including a pair of rotating members which forms the nip portion;

a duct including:

a first duct portion including a first suction port configured to suck air from outside of said image forming apparatus and an exhaust port configured to discharge the air to the outside of said image forming apparatus;

a second duct portion including a second suction port configured to suck air from a neighborhood of said fixing portion, the second suction port facing the pair of rotating members; and a merging portion, provided between the first suction port and the exhaust port, at which air flow from the first suction port and air flow from the second suction port are merged; and a fan configured to form a flow of the air from the first suction port toward the exhaust port in said duct, wherein the second suction port is configured to suck water-containing air generated from the recording material while the recording material is heated at the nip portion.

2. The image forming apparatus according to claim 1, further comprising a discharging portion configured to discharge the recording material, on which the image is fixed at said fixing portion, to the outside of said image forming apparatus, wherein the exhaust port is provided at a position closer to said discharging portion than to said fixing portion with respect to a discharging direction at said discharging portion, and the first suction port is provided at a position more remote from said discharging portion than from said fixing portion with respect to the discharging direction.

3. The image forming apparatus according to claim 1, wherein said fan is provided at a position closer to the exhaust port than to the merging portion of said duct.

4. The image forming apparatus according to claim 1, wherein an airflow rate of the air merged at the merging portion is smaller than an airflow rate of the air sucked at the first suction port.

5. The image forming apparatus according to claim 1, wherein a long dimension of the second duct portion extends along a longitudinal direction of said fixing portion and the second duct portion is connected with the first duct portion at the merging portion.

6. The image forming apparatus according to claim 1, wherein one of the pair of rotating members is a sleeve and the other is a roller.

7. The image forming apparatus according to claim 1, wherein the second suction port is provided directly above the pair of rotating members.

8. The image forming apparatus according to claim 1, wherein a part of the first duct portion between the first suction port and the merging portion is provided above the pair of rotating members, and wherein the part of the first duct portion between the first suction port and the merging portion is provided above the second duct portion.

9. The image forming apparatus according to claim 1, further comprising a discharging portion configured to discharge the recording material, on which the image is fixed at said fixing portion, to the outside of said image forming apparatus, wherein the recording material, on which the image is fixed at said fixing portion, discharged by said discharging portion is cooled by the air discharged from the exhaust port.

10. The image forming apparatus according to claim 1, wherein a part of the first duct portion between the first suction port and the merging portion is provided above the pair of rotating members.

11. The image forming apparatus according to claim 5, wherein inside the first duct portion, air at a portion closer to the exhaust port than to the merging portion is lower in temperature than air inside the second duct portion.

12. The image forming apparatus according to claim 5, wherein an angle formed between a speed vector of the air sucked at the first suction port and a speed vector of the air merged from the second duct portion into the first duct portion at the merging portion is smaller than 90 degrees.

13. The image forming apparatus according to claim 6, wherein said fixing portion includes a heater heating a film, the film contacting the image formed on the recording material at the nip portion.

14. The image forming apparatus according to claim 8, wherein the first duct portion partially overlaps with the second duct portion when viewed from above.

15. The image forming apparatus according to claim 9, wherein said discharging portion is provided above the exhaust port.

16. An image forming apparatus for forming an image on a recording material, said image forming apparatus comprising:

a fixing portion configured to heat-fix the image, formed on the recording material, on the recording material;

a duct including a suction port configured to suck air from outside of said image forming apparatus, a merging portion, and an exhaust port configured to discharge the air to the outside of said image forming apparatus; and a fan configured to form a flow of the air from the suction port toward the exhaust port in said duct, wherein the merging portion is provided between the suction port and the exhaust port, and is configured to merge air from a neighborhood of said fixing portion with the flow of the air from the suction port toward the exhaust port in said duct by taking the air from the neighborhood of said fixing portion inside said duct, and wherein an airflow rate of the air sucked at the suction port is larger than an airflow rate of the air merged from the neighborhood of said fixing portion at the merging portion.

17. The image forming apparatus according to claim 16, wherein said fan is provided at a position closer to the exhaust port than to the merging portion of said duct.

18. An image forming apparatus for forming an image on a recording material, said image forming apparatus comprising:

a fixing portion configured to heat-fix the image on the recording material while conveying the recording material bearing the image at a nip portion, said fixing portion including a pair of rotating members which forms the nip portion;

a duct including:

a first duct portion including a first suction port configured to suck air from outside of said image forming apparatus and an exhaust port configured to discharge the air to the outside of said image forming apparatus;

a second duct portion including a second suction port configured to suck air from a neighborhood of said fixing portion, the second suction port facing the pair of rotating members; and a merging portion, provided between the first suction port and the exhaust port, at which air flow from the first suction port and air flow from the second suction port are merged; and a fan configured to form a flow of the air from the first suction port toward the exhaust port in said duct, wherein the first duct portion extends in a direction crossing a longitudinal direction of the second duct portion.

19. The image forming apparatus according to claim 18, wherein a part of the first duct portion between the first suction port and the merging portion is provided above the pair of rotating members.

20. The image forming apparatus according to claim 18, wherein the second duct portion extends in a direction along a longitudinal direction of the pair of rotating members.

* * * * *